United States Patent [19]

Ferrell

[11] 4,251,936

[45] Feb. 24, 1981

[54] DISPLAY BOARD

[76] Inventor: Robert Ferrell, 64 Park Ave., Freehold, N.J. 07728

[21] Appl. No.: 929,643

[22] Filed: Jul. 31, 1978

[51] Int. Cl.[3] ..... G09F 11/00

[52] U.S. Cl. ..... 40/489; 40/600; 40/621

[58] Field of Search ..... 40/600, 621, 489, 607

[56] References Cited

U.S. PATENT DOCUMENTS

| | | | |
|---|---|---|---|
| 1,694,639 | 12/1928 | Brown | 40/621 X |
| 2,748,498 | 6/1956 | Stuart et al. | 40/621 X |
| 3,168,787 | 2/1965 | Surrey | 40/600 X |
| 3,186,323 | 6/1965 | Niehaus | 40/621 |
| 3,220,127 | 11/1965 | Wilson | 273/29 R |
| 3,383,785 | 5/1968 | Werner | 40/621 X |
| 3,681,857 | 8/1972 | Yardley | 40/621 X |
| 3,928,921 | 12/1975 | Gurman | 40/621 |
| 3,942,147 | 3/1976 | Josephson | 40/621 |
| 4,040,194 | 8/1977 | Penton et al. | 40/621 |

FOREIGN PATENT DOCUMENTS

| | | | |
|---|---|---|---|
| 237106 | 1/1962 | Australia | 40/621 |

*Primary Examiner*—Gene Mancene
*Assistant Examiner*—Wenceslao J. Contreras
*Attorney, Agent, or Firm*—Roger A. Clapp

[57] ABSTRACT

A display unit is disclosed in which a frame assembly magnetically supports a plurality of removable display strips in predetermined patterns and in which alphanumeric character elements are magnetically supported on the display strips and frame assembly in information displaying sets referenced in part by markings located on the surface of the display strips.

4 Claims, 7 Drawing Figures

DISPLAY BOARD

FIELD OF THE INVENTION

1. Backround of the Invention

This invention relates to apparatus for visually displaying information to spectators and pertains to types in which the information being displayed must be manually rearranged as circumstances change as, for example, on scoreboards at athletic contests.

2. Description of the Prior Art

Sporting contests, particularly those which are performed out-of-doors, often require some means of keeping spectators informed of contestant scores. Many types of scoreboard are available, but none have proven satisfactory in all respects. In golf, for example, it is difficult to set up a scoreboard display which combines clear spectator visibility with simple and convenient score changing capacity.

Accordingly, one object of this invention is to achieve clear spectator visibility with ease and convenience in score rearrangements.

In addition, most scoreboards are not readily moved from contest to contest. To the contrary, it is customary to construct special apparatus for each event. Consequently, there is little standardization in the way scores are displayed. If, however, the same scoreboard could be easily transported from event to event, spectators, journalists, contestants and other interested persons would find it far easier to keep track of the proceedings as they are displayed.

Accordingly, another object of this invention is to achieve a scoreboard which can readily be transported yet disseminates scoring information in a clear and readily understandable manner.

SUMMARY OF THE INVENTION

According to a preferred embodiment of the invention, a prefabricated support panel is combined with display strips and alpha-numeric character elements wherein the display strips removably mount on the support panel and the character elements removably mount on both the panel and the display strips in order to achieve a scoreboard that is readily assembled and disassembled for portability.

In accordance with a feature of this invention, the display strips magnetically engage the support panel and the character elements magnetically engage both the support panels and the display strips in order to achieve simple and convenient scoring rearrangements.

In accordance with another feature of this invention, the display strips bear referencing indicia on their surfaces adapted to locate character elements in predetermined locations so as to improve spectator visibility, scoring standardization and ease of scoring change.

A better understanding of these and other objects and features of this invention will be achieved by reference to the following detailed description and drawing.

DETAILED DESCRIPTION OF THE INVENTION

Figure 1:
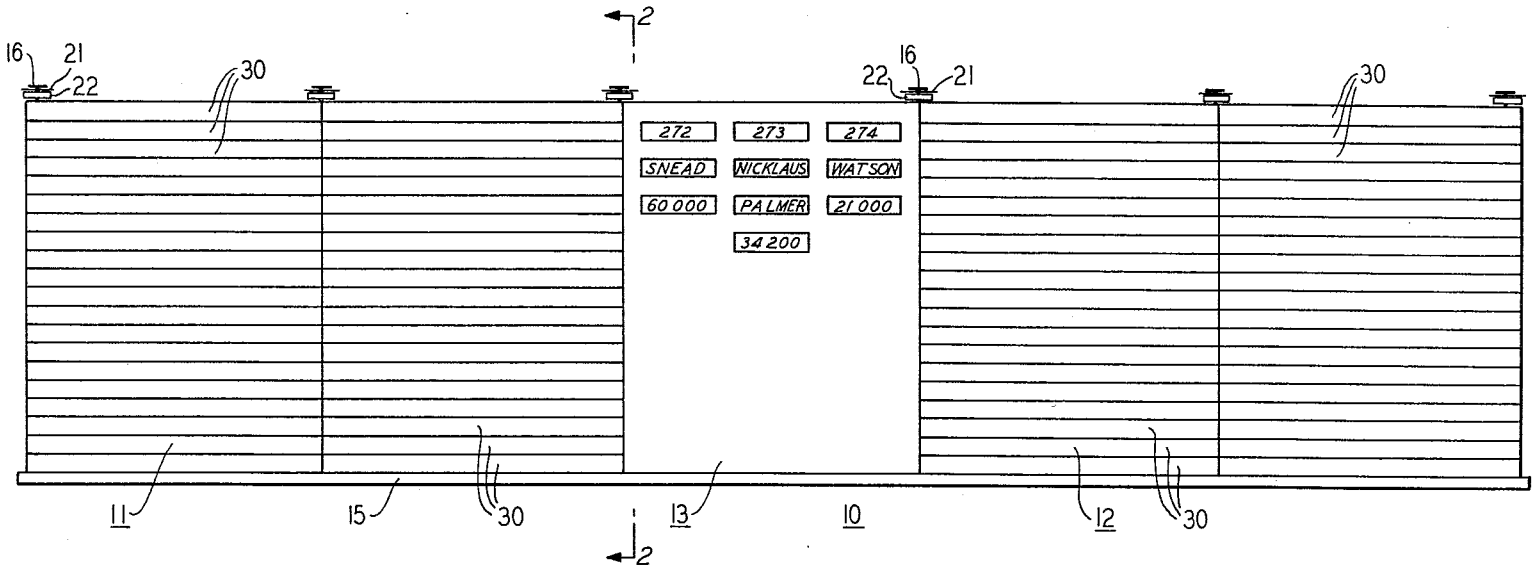
FIG. 1 is a front elevation view of a scoreboard for a sporting contest such as a golf tournament constructed in accordance with this invention.
Figure 2:
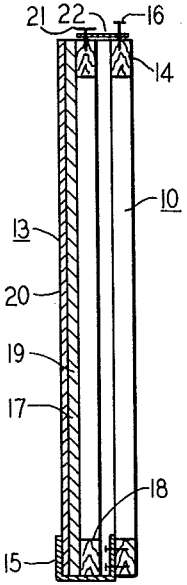
FIG. 2 is an end elevation view of the scoreboard shown in FIG. 1 taken in section along the line 2—2.

Referring to FIG. 1, a scoreboard assembly 10 is disclosed which includes end panel assemblies 11 and 12 bracketing a center panel assembly 13, all of which, as illustrated in FIG. 2, are supported on a frame 14. As will be appreciated, however, the panels 11, 12 and 13 may be juxtoposed in other positions as conditions warrant. The frame 14 is advantageously made of wood (as shown) or it can be made out of suitable metallic material. In either case, the lower edge includes a mounting trough 15, while the upper edge includes means for engaging the panel assemblies; i.e., hook ends 16. The frame 14 may be made with or without supporting legs so as to hold the panel assemblies at a desired viewing height. In the embodiment shown, the scoreboard assembly 10 displays golf scores and the frame 14 advantangeously has a height in the range of five to twenty feet and a length in the range of twenty to forty feet.

The panel assemblies 11, 12 and 13 are all substantially identical so a description of one will suffice for the others. In the embodiment shown, each includes at least one panel 17 which, as best seen in FIG. 2, comprises a frame 18, a base 19 and a mounting sheet 20. The frame 18 in the embodiment illustrated has a width of eight feet and a height of five to twenty feet. As shown, it is made of wood and is covered by the base 19 which can advantageously be made of plywood. The mounting sheet 20 is rigidly attached to the base 19 as by gluing, nailing or the like and comprises a sheet of magnetically responsive material such as 20 gauge steel or the like. The panel 17 includes means for engaging the frame 14 as, for example, a hook pin 21 which is joined to an associated hook pin 16 by an S hook 22. As shown in FIG. 2, the bottom of the panel 17 fits in the trough 15 and the top is held to the frame 14 by the S hooks 22 so that it can readily be mounted and demounted as the occasion warrants.

The panel assemblies are adapted to receive and magnetically hold display strips 30 and character elements 31 on their surfaces. As best seen in FIG. 1, the display strips 30 are mounted on the panel assemblies 11 and 12 one above the other to form vertical columns. In the embodiment illustrated, the two panel assemblies 11 and 12 can accommodate a total of 160 display strips, a number suitable to account for all of the initial contestants in a typical golf tournament. The display strips 30 are all substantially identical, so a description of one will suffice for the others.

Figure 3:
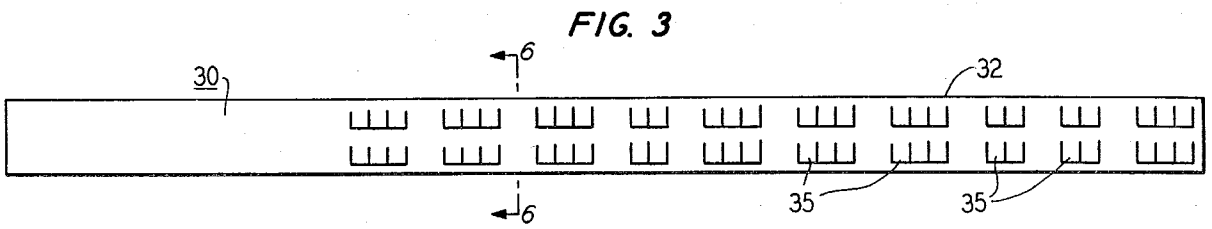
FIG. 3 illustrates a display strip made in accordance with this invention.
Figure 6:
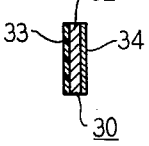
FIG. 6 is an elevation view taken in cross section along the line 6—6 of the display strip shown in FIG. 3

As best seen in FIGS. 3 and 6, each display strip 30 is a thin, rectangularly shaped structure having an inner core 32 made of a magnetically responsive material such as 24 gauge steel or the like, a display surface 33 made of a plastic material such as vinyl and a backing 34 made of a magnetically active material such as a rubber strip impregnated with magnetized particles.

In the embodiment illustrated in FIG. 3, the display strip 30 is adapted for use in a golf tournament and has a height of three and one half to six inches and a length of approximately four feet. The display surface 33 is advantangeously screen processed with index marks 35 adapted to define mounting spaces for character elements 31 of the type illustrated in FIG. 5. Specifically, the marks 35 are laid out on the display strip 30 to provide two horizontal rows each made up of seven three mounting space sets and three two mounting space sets. As illustrated in FIG. 3, moving from left to right, each row has three three mounting space sets followed by a set having two mounting spaces. That group, in turn, is followed by three more three mounting space sets and a set having two mounting spaces. The row ends with one three mounting space set. So arranged, each row is readily adapted to designate hole scores for nine holes followed by a nine hole total, followed by hole scores for another nine holes, followed by another nine hole total followed by an eighteen hole total and ending with a cumulative total. The remaining unmarked portion of the display strip 30 to the left of the marks 35 is adapted to accept a character element 31 such as the one illustrated in FIG. 4 displaying a contestant's name. Thus, when a display strip 30 marked as described is equipped with a character element 31 bearing a contestant's name, it is ready to display comprehensive scoring information for 36 holes of play.

Figure 7:
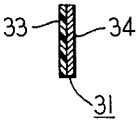
FIG. 7 is an elevation view taken in cross-section along the lines 7—7 of the character elements shown in FIG. 4 and the character element shown in FIG. 5.
Figure 4:
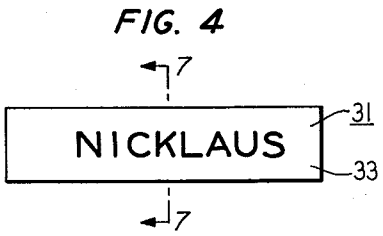
FIG. 4 illustrates a character element bearing the name of a contestant in accordance with the invention.
Figure 5:
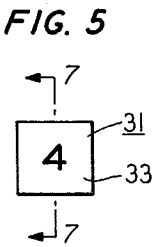
FIG. 5 illustrates a character element bearing a alphanumeric character made in accordance with this invention.

The composition of each character element 31 as shown in FIGS. 4,5 and 7 is similar to that of the display strips 30 in that each is made up of a display surface 33 and a backing 34. The type disclosed in FIG. 4, however, bears alphabetical characters while the type disclosed in FIG. 5 bears alpha-numeric characters both of which can be screen processed on the surface 33 or can be made up of stick-on letters. In the embodiment disclosed, the character element, disclosed in FIG. 4 has a height of four to six inches and a length of approximately 18 inches. Similarly, the type of character elements 31 disclosed in FIG. 5 typically bear a numeral and are designated to cooperate with the marks 35. In addition, the colors of the numbers and letters can be coded as required by tournament demands.

In use, character elements 31 of the type disclosed in FIG. 4 are prepared for each contestant. They are affixed to display strips 30 as needed and the display strips 30 are then mounted on one of the panel assemblies 11 and 12. The display strips 30 are designed to be mutually aligning once preliminary alignment has been established. Consequently, as each is mounted, it acts as a guide for the next. When a tournament begins, therefore, the panel assemblies 11 and 12 will contain display strips for up to one hundred sixty players in the embodiment illustrated. During play, character elements 31 of the type shown in FIG. 5 are added to the display strips 30 as needed.

At the end of 36 holes of play, contestants are typically dropped from the tournament. When that occurs, adjustment of the remaining players on the scoreboard 10 is readily obtained. Specifically, in order to rearrange the player display, it is necessary only to peel off the display strip 30 for a player and relocate it on the scoreboard as necessary or strip it of character elements if the player has been dropped. As each player is dropped from the tournament, the space his display strip 30 occupied can be used for a second display strip 30 for a remaining player. In that case, a player's two display strips 30 are mounted one above the other so as to be adapted to provide a full 72 hole scoring record. In the embodiment illustrated, score headings are printed on the end panel assemblies to identify the information reflected by the character elements 31 as they are added to the display strips 30.

If desired, display strips bearing the names of players not making a cut may be retained on the scoreboard 10. In that case, they will be removed to a suitable location with respect to the active players.

The central panel assembly 13 is designed to provide additional pertinent tournament information. In the display illustrated, gross totals are shown with players at each gross total grouped below along with prize money information. If desired, display strips 30 or character elements 31 of the type disclosed in FIG. 4 can be prepared with appropriate screened-on, stick-on or additional character elements 31 to reflect desired information. It will be readily apparent that other pertinent information can be placed on the central panel in a similar manner.

In view of the modular structure of the panel assemblies, it is apparent that the end panel assemblies 11 and 12 or the central panel assembly 13 can be expanded, contracted or relocated as required for particular tournament demands. When the tournament is over, however, the uniformity of component size makes it easy to dismount and pack the parts of the scoreboard 10 into a compact unit ideally suited for simple and easy transportation.

In summary, a readily portable scoreboard assembly has been disclosed which combines good spectator visibility with convenience and ease in displaying and rearranging scoring information. While only a single embodiment of the invention has been disclosed, it is illustrative of the principles of the invention and it is anticipated that many other embodiments falling within the scope of the invention will readily occur to others skilled in the art.

What I claim is:

1. In display apparatus for disseminating golf scoring information, the combination comprising:

at least one scoring panel assembly and a summary panel assembly, each scoring panel assembly including two end panels suitable for positioning adjacent to each other or on one or both sides of said summary panel assembly, each of said end panels and said summary panel assembly being made of a magnetically responsive material and having a height ranging up to twenty feet;

a plurality of thin, rectangular shaped display strips mounted on each of said end panels one above the other to form columns, each of said display strips having a magnetically responsive core, means magnetically holding said strip to it's end panel and a display surface including printed indexing means disposed in a row to delineate a plurality of character element mounting spaces;

a plurality of thin character elements disposed on said display strips wherein each element includes a surface displaying at least one alpha-numeric character; includes means magnetically attaching said element to it's associated display strip, and is located on said display strip in one of said mounting spaces, and a plurality of thin character elements disposed on said summary panel assembly wherein each element includes a surface displaying at least one alpha-numeric character and includes means for magnetically holding said element on said summary panel assembly.

2. The combination in accordance with claim 1 wherein a portion of said mounting spaces are arranged to serially define three sets of three mounting spaces, one set of two mounting spaces, three sets of three mounting spaces, two sets of two mounting spaces and one set of three mounting spaces.

3. The combination in accordance with claim 2 wherein an elongated mounting space serially precedes said plurality of said mounting spaces to accommodate a character element bearing alphabetical characters arranged to spell out a contestant's name.

4. The combination in accordance with claim 3 wherein said indexing means serially delineates on each display strip an elongated character element mounting space adapted to accommodate a character element bearing alphabetical characters arranged to spell out a contestants name and three sets of three character element mounting spaces followed by one set of two character element mounting spaces, three sets of three character element mounting spaces, two sets of two character element mounting spaces and one set of three character element mounting spaces whereby an identified contestant's score for at least one complete golf round can be linearly displayed on each display strip.

* * * * *